US008550845B1

(12) United States Patent
Osterhart

(10) Patent No.: US 8,550,845 B1
(45) Date of Patent: Oct. 8, 2013

(54) CAM-ACTUATED INDEPENDENT SECONDARY LOCK

(75) Inventor: Michael Paul Osterhart, Milford, MI (US)

(73) Assignee: Yazaki North America, Inc., Canton, MI (US)

( * ) Notice: Subject to any disclaimer, the term of this patent is extended or adjusted under 35 U.S.C. 154(b) by 98 days.

(21) Appl. No.: 13/419,479

(22) Filed: Mar. 14, 2012

(51) Int. Cl.
*H01R 13/40* (2006.01)

(52) U.S. Cl.
USPC ..... 439/595; 439/752

(58) Field of Classification Search
USPC ..... 439/595, 752
See application file for complete search history.

(56) References Cited

U.S. PATENT DOCUMENTS

| | | | | |
|---|---|---|---|---|
| 5,085,599 | A | 2/1992 | Maejima et al. | |
| 5,281,168 | A | 1/1994 | Krehbiel et al. | |
| 5,378,176 | A | 1/1995 | Sasai | |
| 5,595,509 | A | 1/1997 | Fry et al. | |
| 5,810,619 | A | 9/1998 | Miwa | |
| 5,890,935 | A * | 4/1999 | Pill | 439/752 |
| 5,967,859 | A * | 10/1999 | Cecil et al. | 439/752 |
| 6,142,826 | A | 11/2000 | Bourillon | |
| 6,179,671 | B1 * | 1/2001 | Ohsumi | 439/752 |
| 6,409,552 | B2 | 6/2002 | Matsumoto | |
| 6,527,583 | B2 | 3/2003 | Plate | |
| 6,607,407 | B2 * | 8/2003 | Takatsuki et al. | 439/752 |
| 6,666,731 | B2 | 12/2003 | Zweigle et al. | |
| 6,749,469 | B2 | 6/2004 | Matsuoka | |
| 6,808,429 | B2 | 10/2004 | Takada et al. | |
| 6,976,875 | B2 | 12/2005 | Nishide | |
| 7,175,483 | B2 | 2/2007 | Ishikawa | |
| 7,182,652 | B2 | 2/2007 | Yamakado | |
| 7,207,848 | B2 | 4/2007 | Fukatsu et al. | |
| 7,278,890 | B1 | 10/2007 | Smutny et al. | |
| 7,500,875 | B2 | 3/2009 | Lamdiziz et al. | |
| 7,762,826 | B2 | 7/2010 | Hemmi et al. | |
| 7,766,697 | B2 | 8/2010 | Matsumura et al. | |
| 7,775,831 | B2 | 8/2010 | Mase et al. | |
| 8,376,778 | B2 * | 2/2013 | Obata et al. | 439/595 |
| 2009/0186523 | A1 | 7/2009 | Campbell et al. | |

FOREIGN PATENT DOCUMENTS

| | | | |
|---|---|---|---|
| DE | 19538613 | A1 | 5/1996 |

* cited by examiner

*Primary Examiner* — Neil Abrams
(74) *Attorney, Agent, or Firm* — Harness, Dickey & Pierce, P.L.C.

(57) ABSTRACT

A connector assembly according to the present disclosure includes a connector body, a lock reinforcement, and a secondary lock. The connector body has a plurality of terminal cavities and a plurality of lock projections configured to engage a plurality of terminals to retain the terminals in the terminal cavities. The lock reinforcement is slidable relative to the connector body for engagement with a subset of the lock projections to maintain the lock projections engaged with a first subset of the terminals. The secondary lock is slidable relative to the connector body for engagement with a second subset of the terminals to retain the terminals in the terminal cavities independent from the lock projections. The secondary lock is coupled to the lock reinforcement such that moving one of the lock reinforcement and the secondary lock moves the other one of the lock reinforcement and the secondary lock.

20 Claims, 9 Drawing Sheets

CAM-ACTUATED INDEPENDENT SECONDARY LOCK

FIELD

The present disclosure relates to electrical connectors, and more particularly, to cam-actuated independent secondary locks.

BACKGROUND

This section provides background information related to the present disclosure which is not necessarily prior art.

Conventional connectors include a connector body, lock projections, and either a primary lock reinforcement (PLR) or an independent secondary lock (ISL). The lock projections engage a rearward edge of terminals to retain the terminals in terminal cavities. Typically, the PLR and the ISL are adjusted to pre-set positions until the terminals are inserted into the terminal cavities, at which point the PLR and the ISL are independently moved to full-set positions. In its full-set position, the PLR engages the lock projections to prevent the lock projections from deflecting away from terminal cavities. In its full-set position, the ISL engages a rearward edge of the terminals to retain the terminals in the terminal cavities independent from the lock projections.

The decision to use a PLR or an ISL may depend on the type of terminal cavities in a connector and/or the type of application. A single connector may include both a PLR and an ISL. In this case, the PLR and the ISL must be independently moved when the connector is assembled or serviced, increasing the cost and complexity of the connector relative to conventional connectors.

SUMMARY

This section provides a general summary of the disclosure, and is not a comprehensive disclosure of its full scope or all of its features.

A connector assembly according to the present disclosure includes a connector body, a lock reinforcement, and a secondary lock. The connector body has a plurality of terminal cavities and a plurality of lock projections configured to engage a plurality of terminals to retain the terminals in the terminal cavities. The lock reinforcement is slidable relative to the connector body for engagement with a subset of the lock projections to maintain the lock projections engaged with a first subset of the terminals. The secondary lock is slidable relative to the connector body for engagement with a second subset of the terminals to retain the terminals in the terminal cavities independent from the lock projections. The secondary lock is coupled to the lock reinforcement such that moving one of the lock reinforcement and the secondary lock moves the other one of the lock reinforcement and the secondary lock.

In one aspect, the lock reinforcement includes a cam and the secondary lock includes a cam follower. The cam engages the cam follower to move the secondary lock into engagement with the subset of the terminals when the lock reinforcement is moved from a pre-set position to a full-set position.

In another aspect, the connector body defines a first slot and a second slot. The first slot extends longitudinally through the connector body and receives the lock reinforcement. The second slot extends laterally through the connector body and receives the secondary lock.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 1:
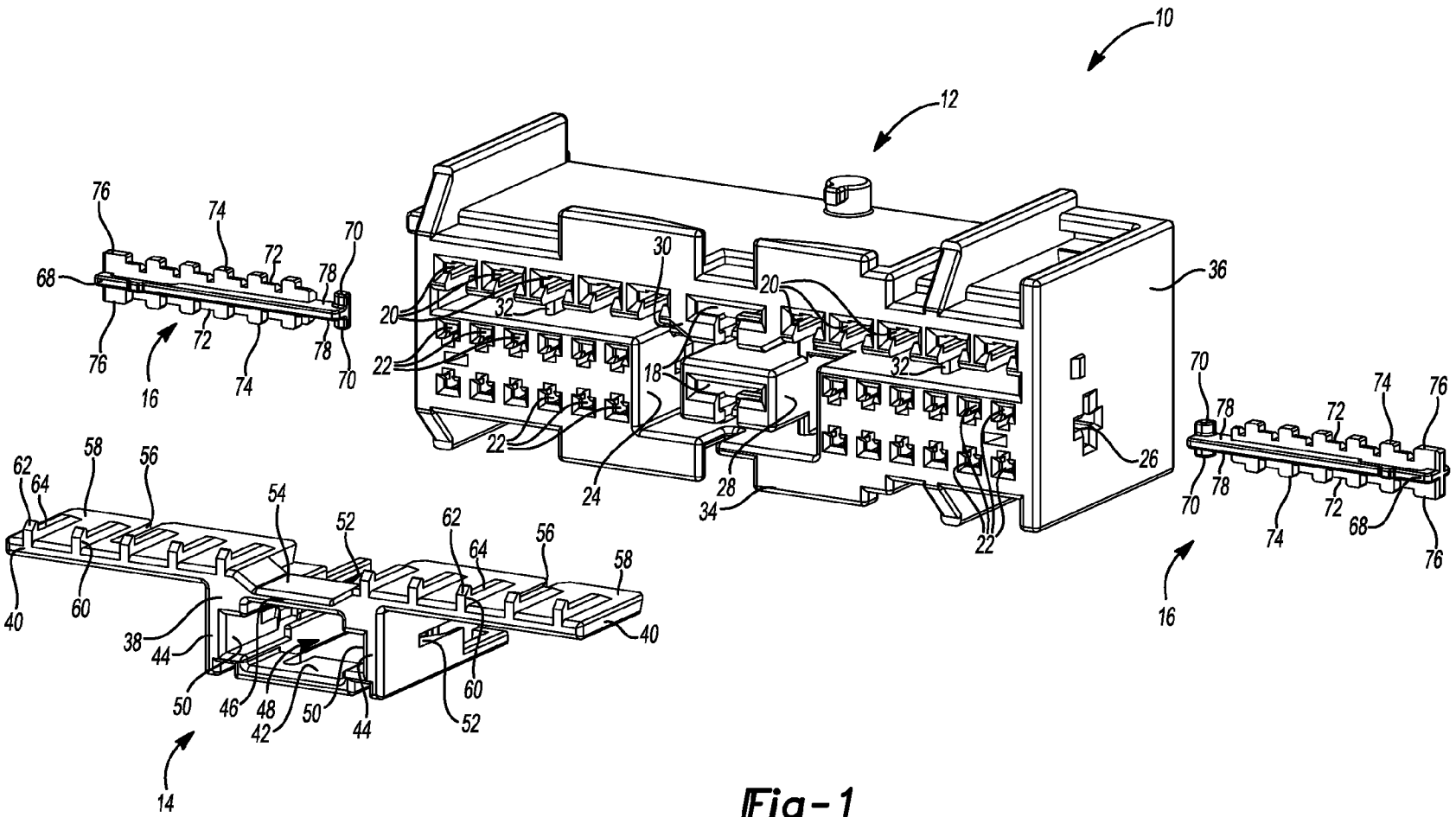
FIG. 1 is an exploded perspective view of a connector assembly constructed in accordance with the teachings of the present disclosure.

With reference to FIG. 1, a connector assembly constructed in accordance with the teachings of the present disclosure is generally indicated by reference numeral 10. The connector assembly 10 can comprise a connector body 12, a primary lock reinforcement (PLR) 14, and a pair of independent secondary locks (ISLs) 16. The connector body 12, the PLR 14, and the ISLs 16 can be separately formed, such as by injection molding, from plastic.

The connector body 12 can have a generally rectangular prismatic shape. The connector body 12 can define a first plurality of terminal cavities 18, a second plurality of terminal cavities 20, a third plurality of terminal cavities 22, a first slot 24, and a pair of second slots 26 (only one shown). The terminal cavities 18 can be larger than the terminal cavities 20, and the terminal cavities 20 can be larger than the terminal cavities 22.

The connector body 12 can include a first terminal housing 28, a second terminal housing 30, and a pair of guide rails 32. The first terminal housing 28 encloses the lower one of the terminal cavities 18, and the second terminal housing 30 encloses the upper one of the terminal cavities 18. The guide rails 32 extend longitudinally beneath the terminal cavities 20.

The first slot 24 can be configured to receive the PLR 14, and the second slots 26 can be configured to receive the ISLs 16. The first slot 24 can extend longitudinally through a front face 34 of the connector body 12, beneath the terminal cavities 18, 20 and between the terminal cavities 18. The second slots 26 can extend laterally through opposite sides 36 (only one shown) of the connector body 12 and between the terminal cavities 22.

The PLR 14 can include a generally rectangular body 38 and a pair of support members 40 that extend laterally outward from the rectangular body 38. The rectangular body 38 can include a base 42, a pair of walls 44 extending upward from the base 42, and a bridge 46 extending between and connecting the walls 44. The rectangular body 38 can define a passage 48 that extends longitudinally through the rectangular body 38. The passage 48 can be configured to receive the first terminal housing 28. The walls 44 can define a pair of tracks 50 that extend longitudinally through the walls 44 and a pair of slots 52 that extend laterally through the walls 44. A top surface 54 of the rectangular body 38 can be indented to accommodate the second terminal housing 30.

Each of the support members 40 can define longitudinally-extending guide slots 56. The guide slots 56 can be configured to receive the guide rails 32 on the connector body 12 as the PLR 14 is inserted into the first slot 24 in the connector body 12. Each of the support members 40 can include a rectangular body 58 and a plurality of projections 60 that extend upward from the rectangular body 58. Each of the projections 60 can include a retention feature 62 and a guide rail 64 that extends longitudinally from the retention feature 62.

Each of the ISLs 16 can have a generally elongated shape and include a rectangular body 68, a pair of bosses 70, alternating projections 72, 74, and a pair of tabs 76. The bosses 70, the projections 72, 74, and the tabs 76 can extend vertically from opposite sides 78 of the rectangular body 68. The projections 72 may have a first height and the projections 74 may have a second height that is greater than the first height.

With reference to FIGS. 2 through 5, the connector assembly 10 is shown in a pre-set condition associated with the PLR 14 and the ISLs 16 being in pre-set positions. The PLR 14 and the ISLs 16 may be adjusted to their respective pre-set positions when the connector assembly 10 is first assembled. The ISLs 16 may be inserted into the connector body 12 before the PLR 14 is inserted into the connector body 12 to avoid interference between the ISLs 16 and the walls 44 of the PLR 14. The PLR 14 and the ISLs 16 may be returned to their respective pre-set positions when the connector assembly 10 is disassembled.

Figure 4:
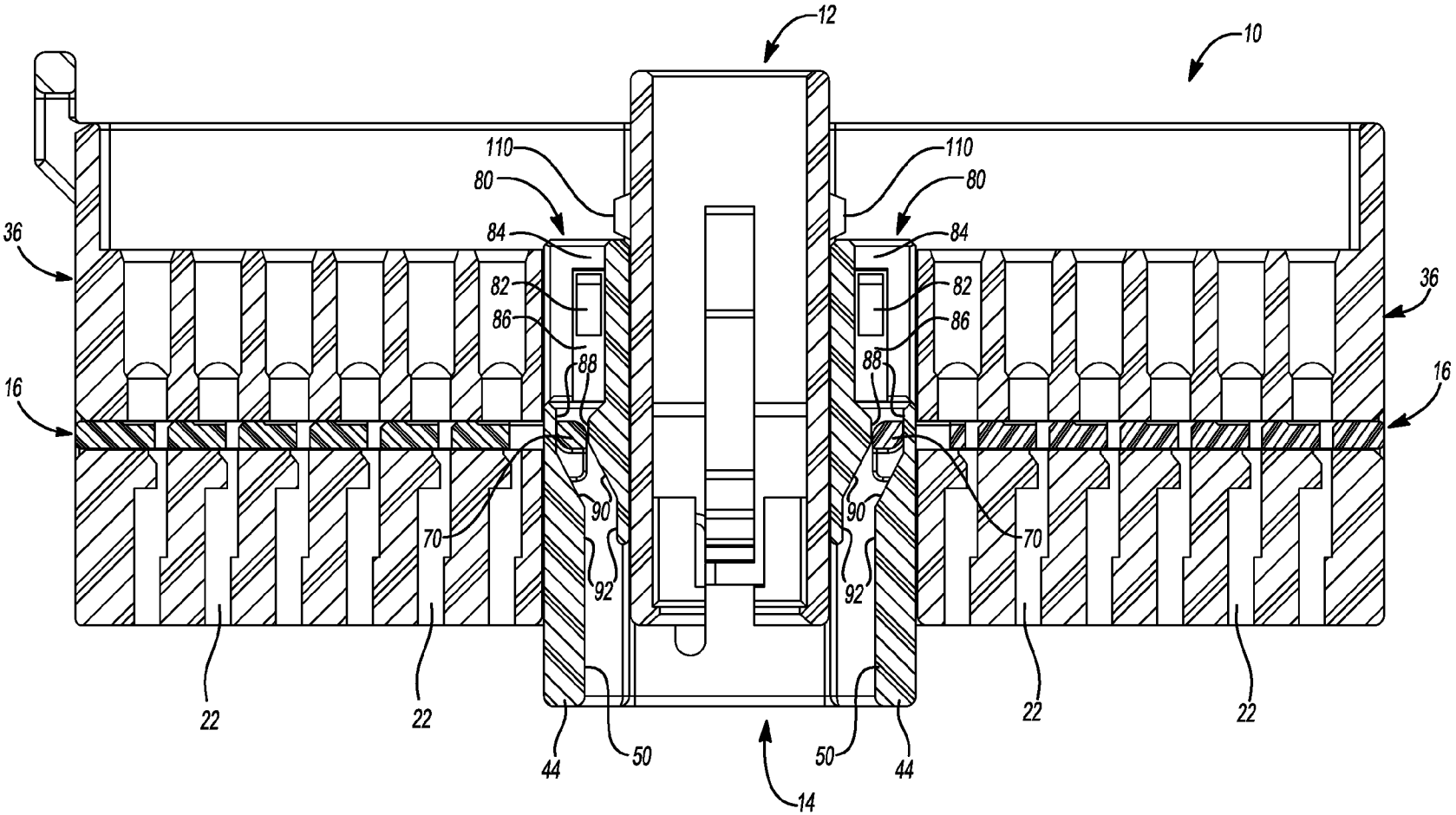
FIG. 4 is a section view of the connector assembly of FIG. 1 taken along the line 4-4 shown in FIG. 3.

With reference to FIG. 4, the connector body 12 and the PLR 14 can cooperate to form a first pair of detents 80 that are configured to maintain the PLR 14 in its pre-set position. Each of the detents 80 can include a ramped projection 82 and a tab 84. The ramped projections 82 extend vertically from a surface 86 of the connector body 12, and the tabs 84 extend laterally along the rear end of the PLR 14. As the PLR 14 is installed in the connector body 12, the tabs 84 can be slid over the ramped projections 82. The ramped projections 82 can then engage the tabs 84 to maintain the PLR 14 in its pre-set position.

Each of the tracks 50 extending through the PLR 14 can include a first portion 88, a second portion 90, and a third portion 92. The first portions 88 can engage the bosses 70 on the ISLs 16 when the PLR 14 and the ISLs 16 are in their respective pre-set positions to maintain the ISLs 16 in their pre-set positions. The first portions 88 and the third portions 92 can extend longitudinally through the walls 44 of the PLR 14. The second portions 90 can extend longitudinally and laterally between the first portions 88 and the third portions 92.

Figure 2:
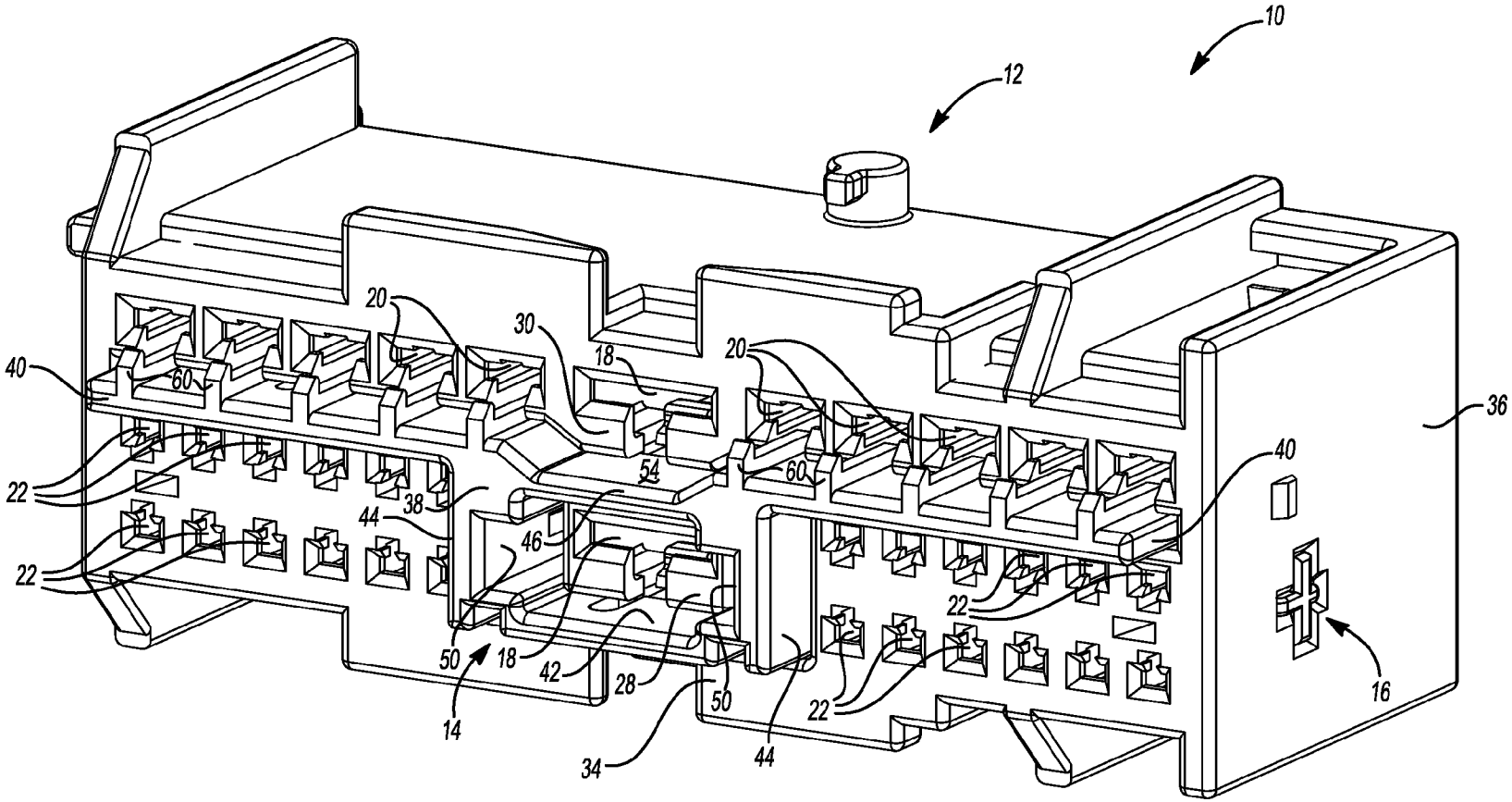
FIG. 2 is a perspective view of the connector assembly of FIG. 1 with the connector assembly in a pre-set condition.
Figure 3:
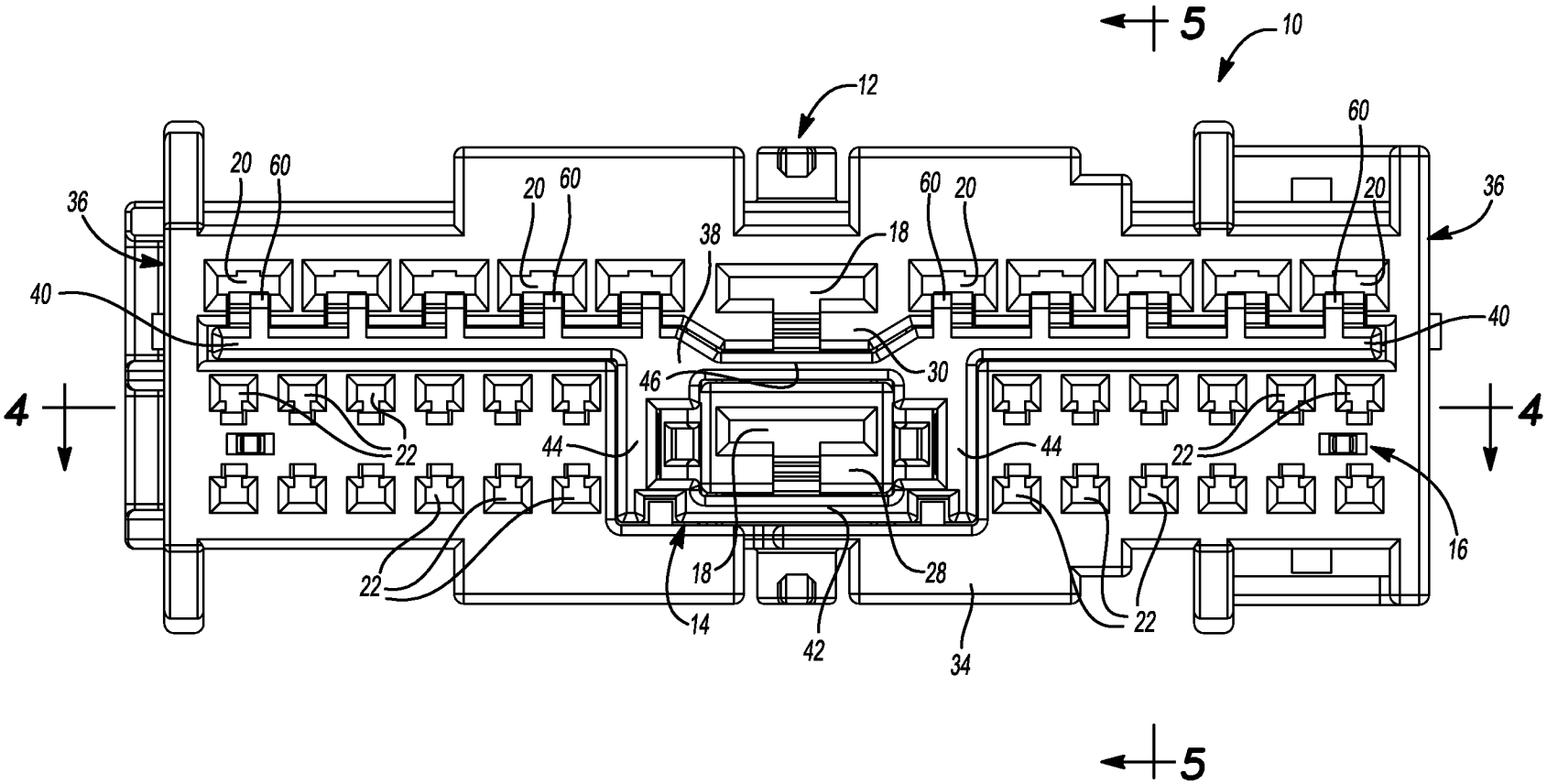
FIG. 3 is a front view of the connector assembly of FIG. 1 with the connector assembly in the pre-set condition.
Figure 5:
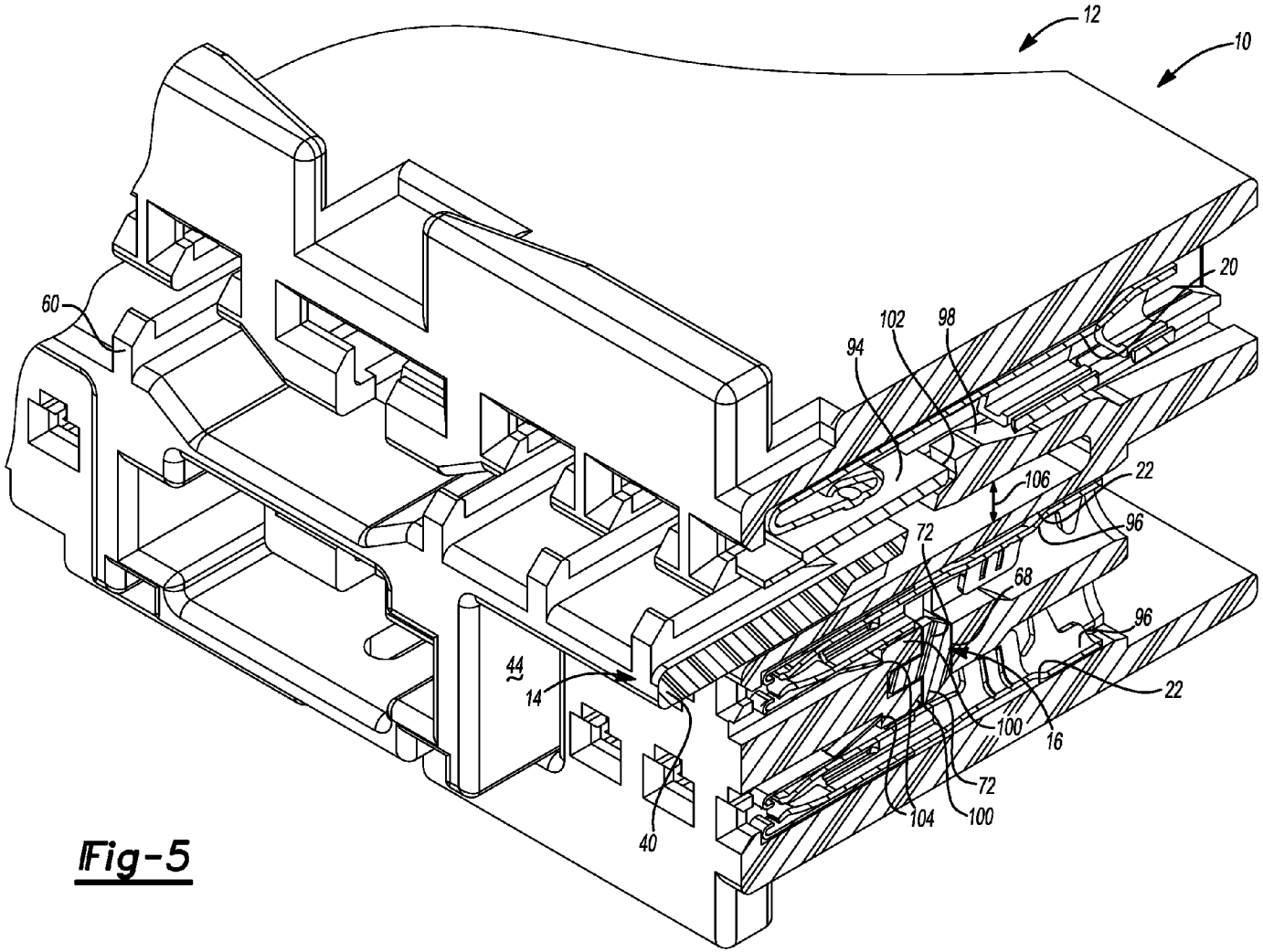
FIG. 5 is a sectioned perspective view of the connector assembly of FIG. 1 taken along the line 5-5 shown in FIG. 3.
Figure 6:
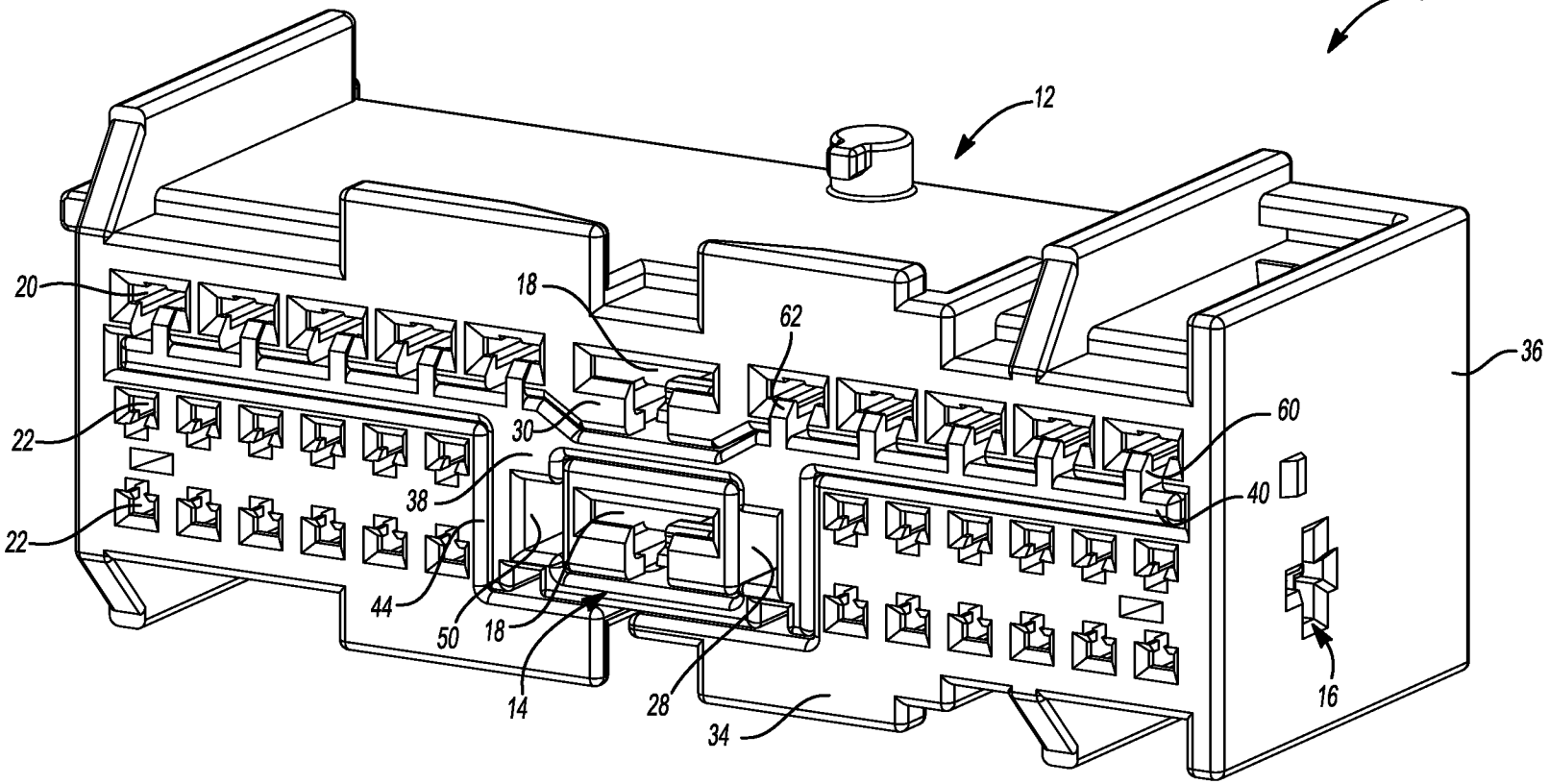
FIG. 6 is a perspective view of the connector assembly of FIG. 1 with the connector assembly in a full-set condition.
Figure 7:
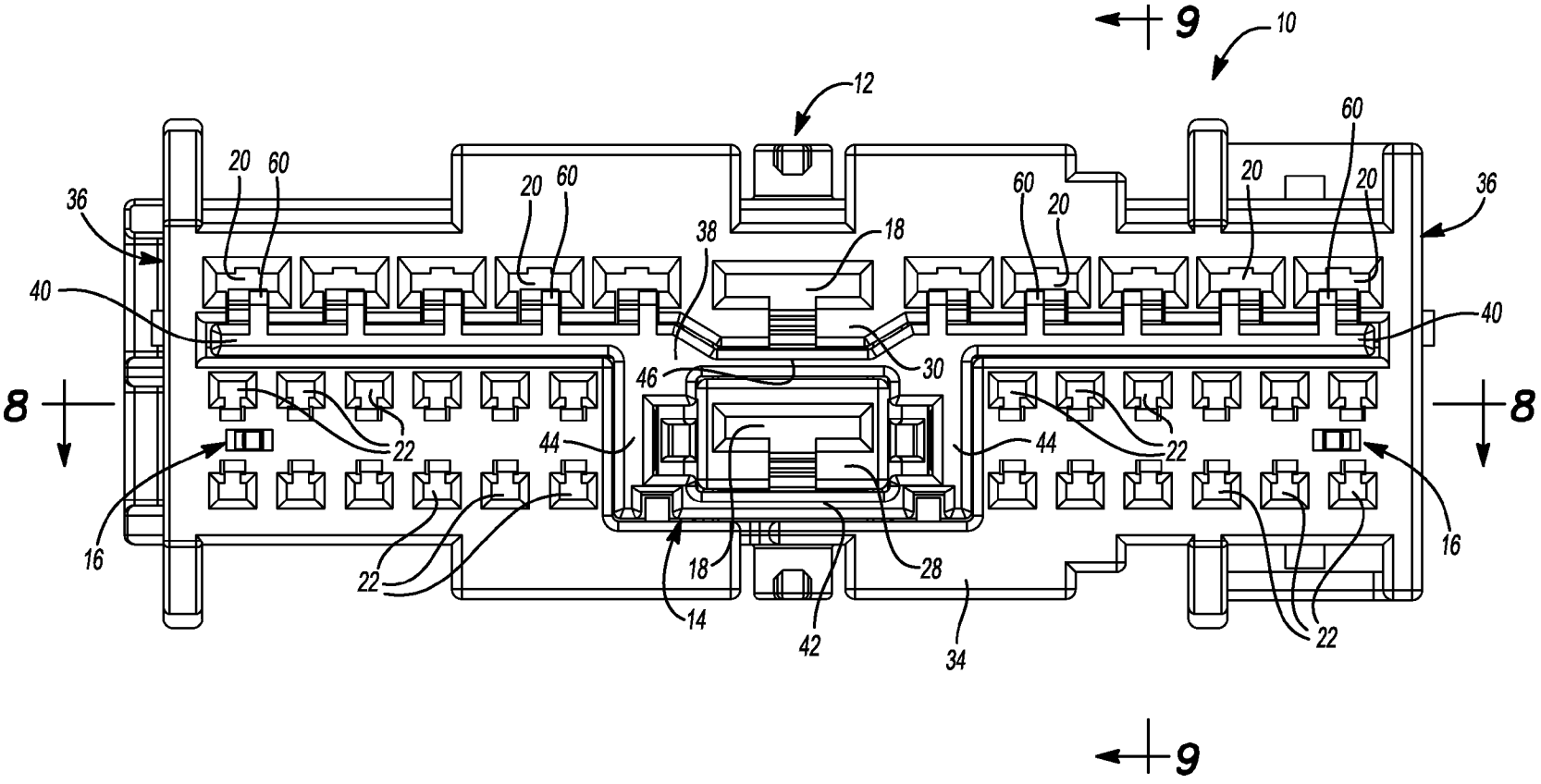
FIG. 7 is a front view of the connector assembly of FIG. 1 with the connector assembly in the full-set condition.

With reference to FIG. 5, the terminal cavities 18 shown in FIGS. 1 through 3 can be configured to receive a first plurality of terminals (not shown), the terminal cavities 20 can be configured to receive a second plurality of terminals 94, and the terminal cavities 22 can be configured to receive a third plurality of terminals 96. The first plurality of terminals can have a first blade width (e.g., 6.3 millimeters (mm)), the second plurality of terminals 94 can have a second blade width (e.g., 2.8 mm), and the third plurality of terminals 96 can have a third blade width. The first blade width can be greater than the second blade width and the second blade width can be greater than the third blade width.

A first plurality of lock projections (not shown), a second plurality of lock projections 98, and a third plurality of lock projections 100 can extend into the terminal cavities 18, 20, 22, respectively, and can be unitarily formed with the connector body 12. The first plurality of lock projections and the second plurality of lock projections 98 can be arms that flex to allow insertion of the first plurality of terminals and the second plurality of terminals 94 into the terminal cavities 18, 20, respectively. When the terminals 94 are installed in the terminal cavities 20, the lock projections 98 can engage a rearward edge 102 of the terminals 94 to retain the terminals 94 in the terminal cavities 20. Similarly, when the terminals 96 are installed in the terminal cavities 22, the lock projections 100 can engage a rearward edge 104 of the terminals 96 to retain the terminals 96 in the terminal cavities 22. The first plurality of lock projections can retain the first plurality of terminals in a similar manner.

When the PLR 14 is in its pre-set position as shown in FIG. 5, the support member 40 of the PLR 14 is retracted from a gap 106 between the lock projections 98 and the connector body 12. Thus, the support member 40 does not prevent the lock projections 98 from flexing downward as the terminals 94 are inserted into or removed from the terminal cavities 20. Therefore, the terminals 94 can be inserted into or removed from the terminal cavities 20 when the PLR 14 is in its pre-set position. Similarly, the support member 40 does not prevent the first plurality of lock projections from flexing as the first plurality of terminals are inserted into or removed from the terminal cavities 18. Therefore, the first plurality of terminals can be inserted into or removed from the terminal cavities 18 when the PLR 14 is in its pre-set position.

When the ISLs 16 are in thier pre-set positions as shown in FIG. 5, the projections 72 on the ISLs 16 are aligned with the terminal cavities 22. The first height of the projections 72 can be selected to avoid interference between the projections 72 and the terminals 96 as the terminals 96 are inserted into or removed from the terminal cavities 22 when the ISLs 16 are in thier pre-set positions. Therefore, the terminals 96 can be inserted into or removed from the terminal cavities 22 when the ISLs 16 are in thier pre-set positions.

With reference to FIGS. 6 through 9, the connector assembly 10 is shown in a full-set condition associated with the PLR 14 and the ISLs 16 being in full-set positions. The PLR 14 and the ISLs 16 may be adjusted to their respective full-set positions after the first plurality of terminals, the second plurality of terminals 94, and the third plurality of terminals 96 are inserted into the terminal cavities 18, 20, 22, respectively. The PLR 14 and the ISLs 16 are mechanically linked such that moving the PLR 14 from its pre-set position to its full-set position moves the ISLs 16 from their pre-set positions to their full-set positions. The mechanical link also ensure that moving the PLR 14 from its full-set position to its pre-set position moves the ISLs 16 from their full-set positions to their pre-set positions. Alternatively, the PLR 14 and the ISL 16 can be mechanically linked such that moving one or both of the ISLs 16 between their pre-set positions and their full-set positions moves the PLR 14 between its pre-set position and its full-set position.

Figure 8:
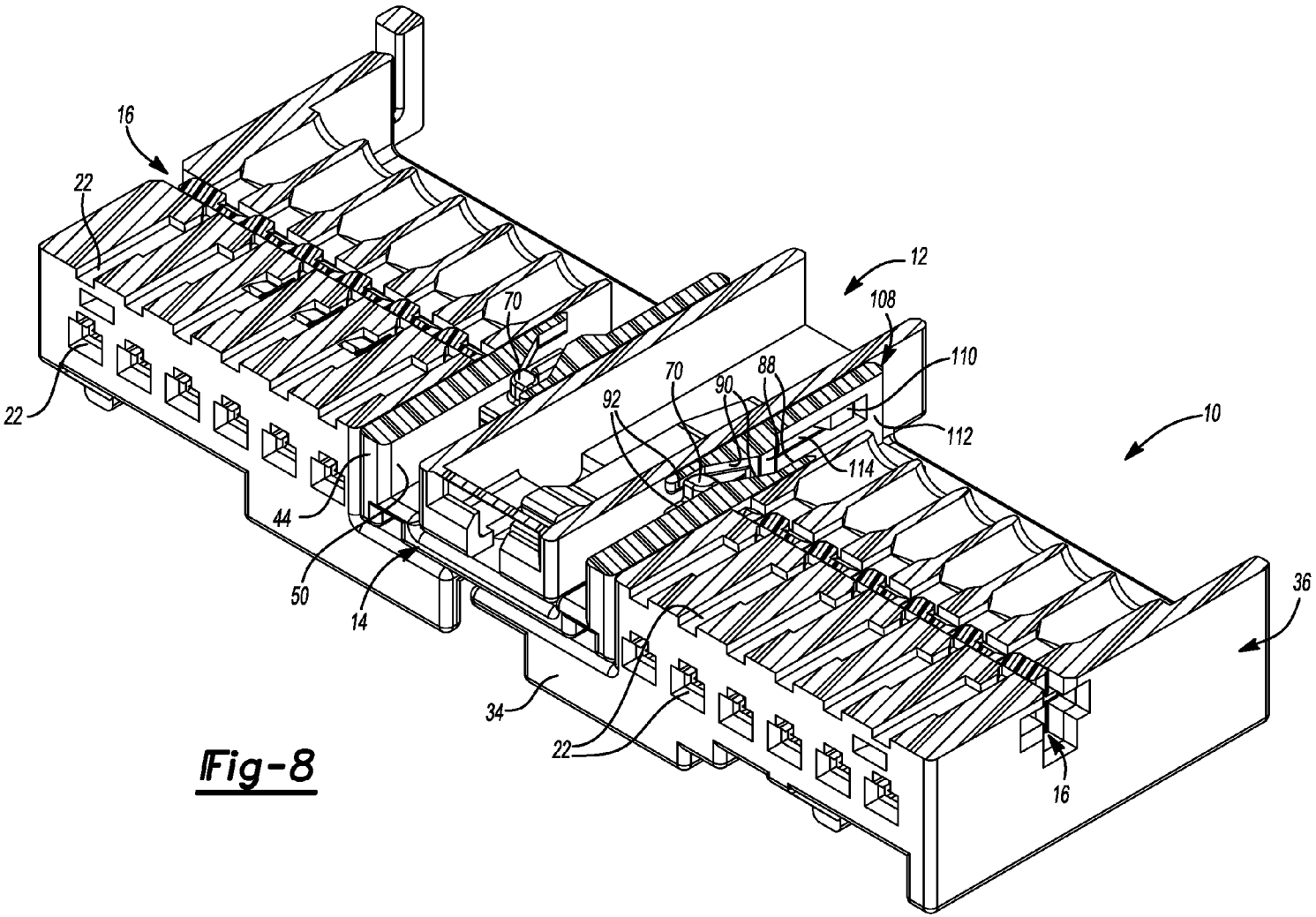
FIG. 8 is a sectioned perspective view of the connector assembly of FIG. 1 taken along the line 8-8 shown in FIG. 7.

With reference to FIGS. 4 and 8, as the PLR 14 is moved from its pre-set position (FIG. 4) to its full-set position (FIG. 8), the second portions 90 of the tracks 50 on the PLR 14 can engage the bosses 70 on the ISLs 16. In turn, the PLR 14 moves the ISLs 16 laterally inward. Thus, as the PLR 14 is moved from its pre-set position to its full-set position, the tracks 50 can engage the bosses 70 to move the ISLs 16 from their pre-set positions to their full-set position.

As the PLR 14 is moved from its full-set position (FIG. 8) to its pre-set position (FIG. 4), the tracks 50 can engage the bosses 70 to move the ISLs 16 laterally outward. Thus, as the PLR 14 is moved from its pre-set position to its full-set position, the tracks 50 can engage the bosses 70 to move the ISLs 16 from their full-set positions to their pre-set positions. In this manner, the PLR 14 and the ISLs 16 can cooperate to form a cam mechanism with the tracks 50 acting as a cam and the bosses 70 acting as a cam follower.

With reference to FIG. 8, the connector body 12 and the PLR 14 can cooperate to form a second pair of detents 108 that are configured to maintain the PLR 14 in its full-set position. Each of the detents 108 can include a ramped projection 110 and a tab 112. The ramped projections 110 extend laterally from a surface 114 of the connector body 12, and the tabs 112 extend vertically along the rear end of the PLR 14. As the PLR 14 is installed in the connector body 12, the tabs 112 can be slid over the ramped projections 110. The ramped projections 110 can then engage the tabs 112 to maintain the PLR 14 in its full-set position. When the PLR 14 and the ISLs 16 are in their respective full-set positions, the third portions 92 of the tracks 50 can engage the bosses 70 on the ISLs 16 to maintain the ISLs 16 in their full-set positions.

Figure 9:
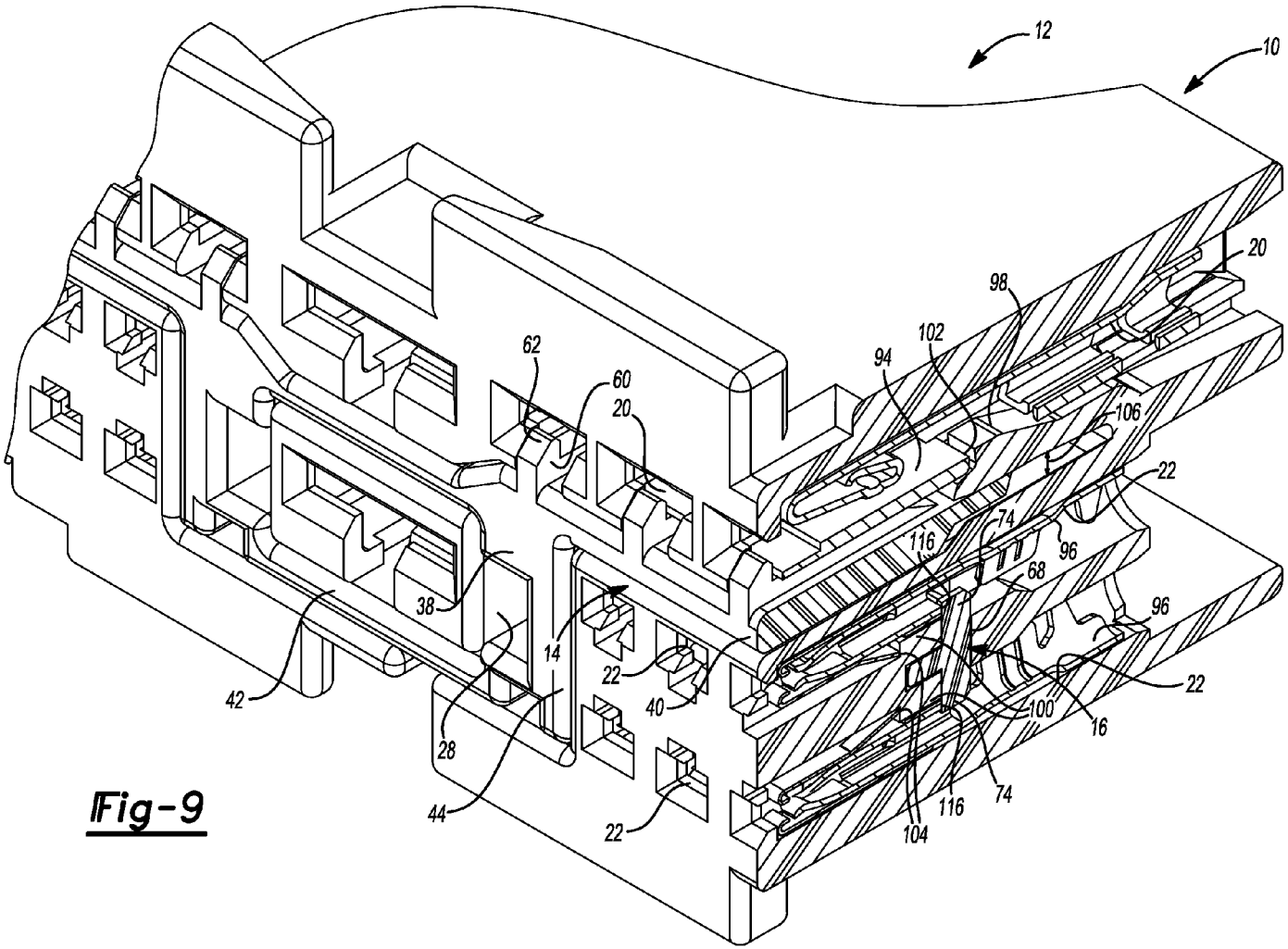
FIG. 9 is a sectioned perspective view of the connector assembly of FIG. 1 taken along the line 9-9 shown in FIG. 7.

With reference to FIG. 9, when the PLR 14 is in its full-set position as shown, the support member 40 of the PLR 14 is disposed in the gap 106 between the lock projections 98 and the connector body 12. Thus, the support member 40 supports the lock projections 98 by preventing the lock projections 98 from flexing downward. In this manner, the PLR 14 reinforces the lock projections 98 to retain the terminals 94 in the terminal cavities 20 when the PLR 14 is in its full-set position. Similarly, the support member 40 supports the first plurality of lock projections by preventing the first plurality of lock projections from flexing vertically when the PLR 14 is in its full-set position. In this manner, the PLR 14 reinforces the first plurality of lock projections to retain the first plurality of terminals in the terminal cavities 18 when the PLR 14 is in its full-set position.

When the ISLs 16 are in their full-set positions as shown in FIG. 9, the projections 74 on the ISLs 16 are aligned with the terminal cavities 22. In turn, when the terminals 96 are installed in the terminal cavities 22, the projections 74 on the ISLs 16 engage a rearward edge 116 of the terminals 96 to retain the terminals 96 in the terminal cavities 22. In this manner, the ISLs 16 retains the terminals 96 in the terminal cavities 22 independent from the lock projections 100 on the connector body 12 when the ISLs 16 are in their full-set positions.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

For example, in the embodiments described above, the PLR 14 and the ISLs 16 cooperate to form a cam mechanism with the PLR 14 including the tracks 50 that act as a cam and the ISLs 16 including the bosses 70 that act as a cam follower. Additionally or alternatively, the PLR 14 can include a feature that acts as cam follower and the ISLs 16 can include a feature that acts as a cam. Furthermore, the PLR 14 and the ISLs 16 can be mechanically linked using other mechanisms such gears, linkages, and/or flexure mechanisms. Moreover, in the embodiments described above, the PLR 14 is mechanically linked to the pair of ISLs 16. However, the PLR 14 can be mechanically linked to a single ISL, or the PLR 14 can be mechanically linked to more than two ISLs.

What is claimed is:

1. A connector assembly comprising:

a connector housing having a connector body with a plurality of terminal cavities, a first slot, and a second slot, the plurality of terminal cavities being configured to receive a plurality of terminals, the first slot extending longitudinally through the connector body, the second slot extending laterally through the connector body, the connector body including a first plurality of lock projections that are configured to engage a first edge of the plurality of terminals to retain the plurality of terminals in the plurality of terminal cavities;

a lock reinforcement that is slidably received in the first slot for movement between a first position and a second position, the lock reinforcement engaging a subset of the lock projections when the lock reinforcement is in the second position to prevent deflection of the lock projections away from a first subset of the terminal cavities, the lock reinforcement including a cam;

a secondary lock that is slidably received in the second slot for movement between a third position and a fourth position, the secondary lock being configured to engage a second edge of a subset of the terminals when the secondary lock is in the fourth position to retain the terminals in a second subset of the terminal cavities, the secondary lock including a cam follower that is engaged with the cam; and wherein the cam and the cam follower cooperate when the lock reinforcement is moved in the first slot from the first position to the second position to move the secondary lock in the second slot from the third position to the fourth position.

2. The connector assembly of claim 1 wherein the first plurality of lock projections extend longitudinally from the connector body.

3. The connector assembly of claim 2 wherein the lock reinforcement includes a support member that supports the first subset of the lock projections by filling a gap between the lock projections and the connector body when the lock reinforcement is in the second position.

4. The connector assembly of claim 1 wherein the secondary lock includes a second plurality of lock projections that project into the second subset of the terminal cavities and that are configured to engage the second edge of the subset of the terminals when the secondary lock is in the fourth position.

5. The connector assembly of claim 1 wherein the cam and the cam follower are configured to inhibit movement of the secondary lock away from the third position when the lock reinforcement is in the first position.

6. The connector assembly of claim 1 wherein the cam includes a first portion that engages the cam follower when the lock reinforcement is in the first position and a second portion that engages the cam follower when the lock reinforcement is in the second position, the cam extending longitudinally and laterally between the first portion and the second portion.

7. The connector assembly of claim 1 further comprising a first detent, which is configured to maintain the lock reinforcement in the first position, and a second detent that is configured to maintain the lock reinforcement in the second position.

8. The connector assembly of claim 7 wherein the first detent and the second detent each include a ramped projection and a tab, the ramped projection extending into the first slot, the tab coupled to the lock reinforcement and being configured to slide over the ramped projections as the lock reinforcement is translated in the first slot.

9. The connector assembly of claim 1 wherein the lock reinforcement and the secondary lock are configured to permit the plurality of terminals to be inserted into the plurality of terminal cavities when the lock reinforcement and the secondary lock are in the first position and the third position, respectively.

10. The connector assembly of claim 1 wherein the first slot extends adjacent to the first subset of the terminal cavities.

11. The connector assembly of claim 1 wherein the second slot extends through the second subset of the terminal cavities.

12. The connector assembly of claim 1 wherein the secondary lock includes a pair of secondary locks, the secondary locks being inserted into opposite sides of the connector body.

13. A connector assembly comprising:

a connector body having a plurality of terminal cavities and a plurality of lock projections that are configured to engage a first edge of the plurality of terminals to retain the plurality of terminals in the plurality of terminal cavities;

a lock reinforcement that is slidably engaged with the connector body, the lock reinforcement being movable to engage a subset of the lock projections to prevent the lock projections from deflecting away from a first subset of the terminal cavities;

a secondary lock that is slidably engaged with the connector body, the secondary lock being movable to engage a second edge of a subset of the terminals to retain the terminals in a second subset of the terminal cavities; and wherein the lock reinforcement engages the secondary lock, and wherein movement of one of the lock reinforcement and the secondary lock from a first position, which is associated with the connector assembly being in a pre-set condition, to a second position moves the other one of the lock reinforcement and the secondary lock such that the connector assembly is in a full-set condition.

14. The connector assembly of claim 13 wherein the connector housing defines a first slot and a second slot, the first slot extending longitudinally through the connector body and receiving the lock reinforcement, the second slot extending laterally through the connector body and receiving the secondary lock.

15. The connector assembly of claim 13 wherein the lock reinforcement includes a cam and the secondary lock includes a cam follower, the cam engaging the cam follower to move the secondary lock from a third position to a fourth position when the lock reinforcement is moved from the first position to the second position.

16. The connector assembly of claim 13 wherein the first subset of the terminal cavities and the second subset of the terminal cavities are proper subsets of the plurality of terminal cavities, and wherein the terminal cavities included in the second subset are different from the terminal cavities included in the first subset.

17. A connector assembly comprising:

a connector body having a plurality of terminal cavities and a plurality of lock projections that are configured to engage a plurality of terminals to retain the plurality of terminals in the plurality of terminal cavities;

a lock reinforcement that is slidable relative to the connector body for movement between a pre-set position and a full-set position, the lock reinforcement being configured to engage a subset of the lock projections to maintain the lock projections in engagement with a first subset of the terminals when the lock reinforcement is in the full-set position; and a secondary lock that is slidable relative to the connector body and is coupled to the lock reinforcement, the secondary lock being configured to engage a second subset of the terminals to retain the plurality of terminals in the plurality of terminal cavities independent from the plurality of lock projections when the lock reinforcement is in the full-set position.

18. The connector assembly of claim 17 wherein the connector body defines a first slot and a second slot, the first slot extending longitudinally through the connector body and receiving the lock reinforcement, the second slot extending laterally through the connector body and receiving the secondary lock.

19. The connector assembly of claim 17 wherein the lock reinforcement includes a cam and the secondary lock includes a cam follower, the cam engaging the cam follower to move the secondary lock into engagement with the second subset of the terminals when the lock reinforcement is moved from the pre-set position to the full-set position.

20. The connector assembly of claim 17 wherein the first subset of the terminal cavities and the second subset of the terminal cavities are proper subsets of the plurality of terminal cavities, and wherein the terminal cavities included in the second subset are different from the terminal cavities included in the first subset.

* * * * *